US008485577B2

(12) United States Patent
Lammi et al.

(10) Patent No.: US 8,485,577 B2
(45) Date of Patent: Jul. 16, 2013

(54) GRIPPING FOR LIFTING MATERIAL WEB ROLLS, PARTICULARLY PAPER-AND PAPERBOARD ROLLS

(75) Inventors: Matti Lammi, Vanha-Ulvila (FI); Jouko Helminen, Sakyla (FI); Jarmo Pohjolainen, Vanha-Ulvila (FI)

(73) Assignee: Raumaster Paper Oy, Rauma (FI)

( * ) Notice: Subject to any disclaimer, the term of this patent is extended or adjusted under 35 U.S.C. 154(b) by 264 days.

(21) Appl. No.: 12/522,729

(22) PCT Filed: Nov. 16, 2007

(86) PCT No.: PCT/FI2007/050617

§ 371 (c)(1),
(2), (4) Date: Jul. 10, 2009

(87) PCT Pub. No.: WO2008/084134

PCT Pub. Date: Jul. 17, 2008

(65) Prior Publication Data

US 2010/0014955 A1 Jan. 21, 2010

(30) Foreign Application Priority Data

| | | |
|---|---|---|
| Jan. 12, 2007 | (FI) | 20070030 |
| Feb. 7, 2007 | (FI) | 20080194 |
| Oct. 29, 2007 | (FI) | 20070815 |

(51) Int. Cl.
*B66C 1/00* (2006.01)
*E21B 19/07* (2006.01)

(52) U.S. Cl.
USPC ..... 294/113; 294/106; 294/119.1

(58) Field of Classification Search
USPC ..... 294/67.33, 205, 207, 113, 114, 119.1, 294/119.2, 106
See application file for complete search history.

(56) References Cited

U.S. PATENT DOCUMENTS

| | | | | | |
|---|---|---|---|---|---|
| 201,648 | A | * | 3/1878 | Bulkeley | 294/118 |
| 767,884 | A | * | 8/1904 | Harris et al. | 294/67.3 |
| 1,730,705 | A | * | 10/1929 | Wild | 294/86.29 |
| 1,808,689 | A | * | 6/1931 | Stenhouse et al. | 198/803.7 |
| 2,076,758 | A | | 4/1937 | Whiting | |
| 2,959,444 | A | | 11/1960 | Callender | |
| 3,057,654 | A | | 10/1962 | Beauchamp, Jr. | |
| 3,397,907 | A | * | 8/1968 | Trowbridge | 294/81.61 |
| 5,163,727 | A | * | 11/1992 | Slezak et al. | 294/81.2 |
| 5,797,479 | A | * | 8/1998 | Hyyrylainen | 198/456 |

FOREIGN PATENT DOCUMENTS

| | | | |
|---|---|---|---|
| DE | 262646 | A1 | 12/1988 |
| DE | 38 22 228 | A1 | 1/1990 |
| DE | 197 16 747 | A1 | 10/1998 |
| FR | 2 699 908 | A1 | 7/1994 |
| FR | 2 859 197 | A1 | 3/2005 |
| RU | 1 640 913 | A1 | 4/1994 |

OTHER PUBLICATIONS

Finland Search Report: 20070030.
International Search Report: PCT/FI2007/050617.

* cited by examiner

*Primary Examiner* — Stephen Vu
(74) *Attorney, Agent, or Firm* — Ladas & Parry LLP

(57) ABSTRACT

A gripper having contact members arranged to be positioned against the sides of a roll to be lifted. A gripping force is provided on the contact members at substantially gripping height against the roll to be lifted by tensioning a binder connecting the contact members.

1 Claim, 12 Drawing Sheets

GRIPPING FOR LIFTING MATERIAL WEB ROLLS, PARTICULARLY PAPER-AND PAPERBOARD ROLLS

FIELD OF THE INVENTION

The invention relates to gripping for lifting material web rolls.

BACKGROUND OF THE INVENTION

Due to the effect of wind loads on a bridge crane, for example, roll piles in a warehouse do not always become concentric with regard to all of the rolls. Due to damage to surface layers and other reasons, a varying number of web layers are removed from some of the rolls. Thus the diameter of rolls arriving in a warehouse, even rolls originating from the same trim-width roll set, may vary even tens of millimeters. Current up-enders do not centralize rolls in a roll set, but one side of the envelope surface of the rolls becomes substantially uniform with regard to the rolls in the roll set. The staggering caused by the diameter variation of the rolls accumulates on the opposite envelope surface. Thus the whole diameter variation becomes staggered on one side. In addition to the above, inaccuracies related to the operation of the crane also have an effect. As a combined effect of all these factors, the radial staggering of rolls piled in the warehouse may be several centimeters.

The compactness the matrix in which the piles can be positioned in a vertical roll warehouse has economic impact. Extra space between piles causes additional costs in terms of a broader extension of the bridge crane and a larger building surface area and reduces storage rate.

If it is necessary to include such structures in a gripper that extend below the roll/roll set during moving, the use of space becomes less efficient as more space must be reserved for the horizontal movement of the crane above the piles in the warehouse. Thus it is desirable to be able to ensure a safe hold during moving without having securing structures extending below the lowest roll.

Patent specification FR 2859197 discloses a secure solution per se for maintaining a safe hold of an object to be moved during the moving. The solution is suitable for a constant-sized drum, but less so for a paper roll, in which the location of the lower end may vary over a wide range, extending 0.3 to 4.5 m below the gripping mechanism. Scissor-type grippers are described on the website of Bushman Equipment Inc. at www.busman.com/prod_tgripper_broch.asp. The grippers in question are not suitable for handling vertical paper rolls. The grip is applied to a small surface area and damages at least the wrapper, possibly the roll as well.

Typically, scissor mechanisms provide the advantage of automatically increasing the gripping force when the weight of the load increases. Solutions are also disclosed in patent specifications DE 3822228 and U.S. Pat. No. 2,959,444. However, the mechanisms described represent solutions requiring a fairly large amount of space, and the compression force is not optimal over the whole diameter range. Patent specification FR 2699908 discloses a wedging mechanism that provides a grip at the upper end of a roll.

Thus it is common to known grippers compressing the envelope surface of the roll that they are unable to convey any significant compression force very far downwards. However, downward extension is a necessary feature in order to be able to transport roll sets of a plurality of rolls at the same time. If the mechanism providing the compression force on the gripper is located above the roll/roll pile and the compression force is moved 2.5 to 3 m downwards, this results in such massive structures that their application is not economically viable.

Known scissor-type solutions also operate in a very limited diameter range. They are not able to cover the range of 700 mm to 1,600 mm, typical of paper roll production. With paperboard rolls, the range may be even wider.

BRIEF SUMMARY OF THE INVENTION

The object of the invention is to overcome or at least alleviate problems related to gripping.

In accordance with a first aspect of the invention, a gripper as claimed in claim 1 is provided.

The solution in accordance with the invention enables providing a good grip by simple means. As the weight of the load may cause the gripping force to increase, the grip strengthens automatically as necessary during moving. A preferable gripper structure enables modifying the compression force substantially in relation to the diameter and/or weight of the roll. This also simplifies automation as one variable can be omitted.

Advantageously, the same gripper can be used for handling both packaged and unpackaged rolls covering the entire diameter range of a mill's rolls. The gripper may still require a relatively small amount of space, even though the compression force of the grip can be rated to be sufficient for loads up to more than ten metric tons. When the grip is applied to the lowest roll in a pile, even a plurality of rolls can be transported at the same time. The hold of the grip becomes safer than with a suction grip. The grip can be maintained over even long-term power failures.

The gripper may be equipped with radio frequency identification (RFID) reading means. In order to improve the reliability of RFID reading, the gripper may comprise RFID antennae at a plurality of angle orientations so that shadow zones are eliminated or significantly reduced. Having more than two contact members provide a possibility of an antenna layout deviating from 180-degree sectioning. Eliminating or reducing orientations with shadow zones enables significantly improving the reliability of RFID reading.

The gripper may applied connected to a bridge crane in vertical roll warehouses, for example. The gripper may also be provided in connection with a portal robot or another moving apparatus. In addition to storage, the gripper may be applied to other types of roll handling in a paper or paperboard mill, such as in a dispatch department for forming loads.

In accordance with a second aspect of the invention, a system as claimed in claim 10 is provided.

Thanks to a self-centralizing grip and a gripper capable of being accommodated in a relatively small space and capable of lifting a plurality of rolls piled on top of each other, the system can be implemented with a relatively small storage field compared with the storage capacity and thus the moving period of the rolls may remain relatively short. Implementing a comparable storage capacity may be achieved with a lower number of cranes than with prior art solutions or with smaller cranes than in prior art. It is apparent that the grip in accordance with the first aspect provides the entire storage system with advantages iterated in a number of ways so that the increase in the capacity of the entire storage system may provide added value exceeding the price of the gripper.

In accordance with a third aspect of the invention, a system as claimed in claim 11 for gripping a vertical material web roll is provided.

Various embodiments of the invention are set forth in the appended dependent claims. It should be appreciated that inventions in accordance with various embodiments may be combined with inventions as claimed in various independent claims.

Various embodiments of the invention will be presented in the following by way of example with reference to the appended drawings without, however, confining the invention to the examples presented.

DETAILED DESCRIPTION OF THE INVENTION

In accordance with one embodiment of the invention, a compression force is provided on contact members 4 of a gripper 2 for compressing a material web roll 1 by generating substantially at a gripping height a tensile stress in one or more tensioners or binders 18 surrounding the material web roll 1, which tensile stress causes the compression force between the contact members 4 and the material web roll 1. The binder may pass round one or more contact members; preferably at least three contact members, and/or the binder may be fastened to the edge of one or more contact members so that the contact member or its body forms part of the binder. One preferred embodiment includes six contact members.

Figure 1:
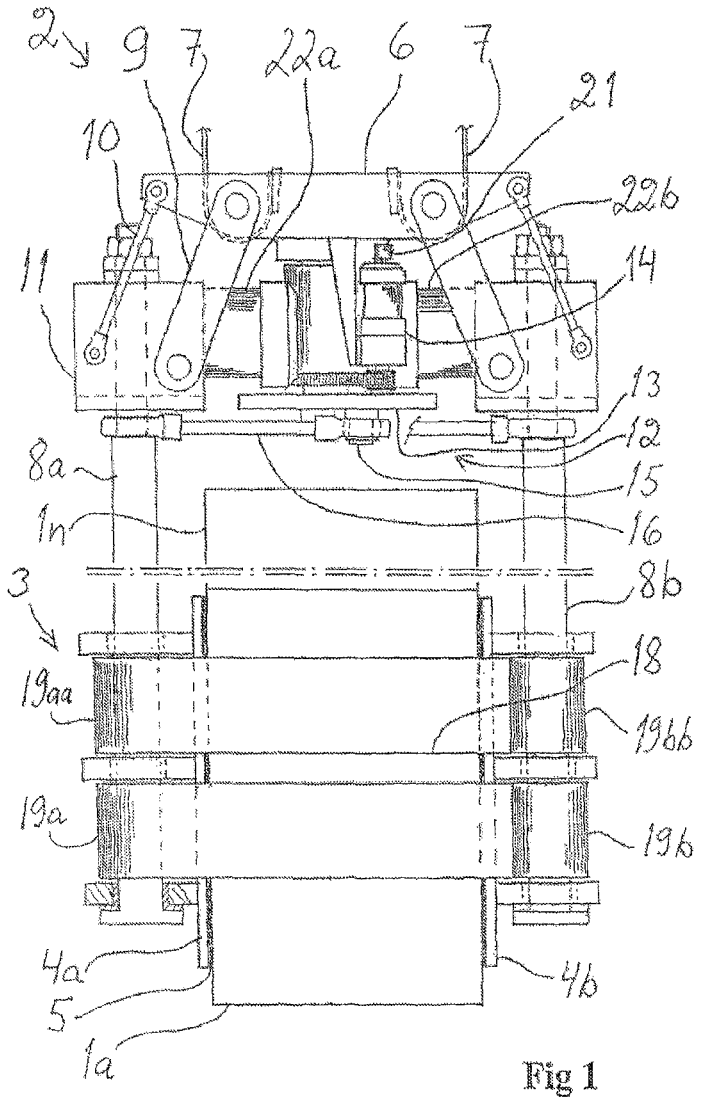
FIG. 1 shows a partially sectional and simplified side view of one embodiment of the invention.

For the sake of clarity, FIG. 1 shows two winding mechanisms located at opposite sides of a center axis. Alternatively, more or fewer winding mechanisms may be provided. A roll 1*a* is held by two contact members 4*a*, 4*b* of a gripping apparatus 3 of the gripper 2. In practice, more contact members/lifting members are more preferably provided. One or more rolls may be transported on top of the roll 1*a* being gripped. In the figure, the top-most roll in the pile is 1*n*. A body 6 of the gripper 2 is connected to a lifting mechanism of an actual moving apparatus, such as a bridge crane, by means of wire ropes 7 or similar. On the other hand, connection to a lifting arm of a portal robot is most preferably provided by means of joints. Therein loads applied to the structures of the robot during moving may typically be limited to a reasonable level. A moving apparatus for lifting members 8 is fastened to the body 6 of the gripper, preferably with even spacing, which moving apparatus moves the lifting members 8 towards the roll when gripping and away from the roll at the release phase. In one embodiment of the invention, the moving apparatus is implemented using a parallellogram wherein levers 9 and 10 are pivotally mounted at their upper ends to lugs in the body 6 and at their lower ends to a fastener 11 of the lifting member. Naturally, the moving apparatus may be implemented using other types of members known per se, such as by means of fixed linear guides with moving carriages guided by them or vice versa.

A centralizing mechanism 12 is most preferably provided at the center of the body 6. In the centralizing mechanism a turnplate 13 mounted on a bearing to be able to rotate in relation to the body 6 is rotated by a power unit 14 by means of a belt or chain drive, a gear assembly or other transmission. The turnplate has shafts 15 on the same perimeter with even spacing. Moving arms 16 are pivotally fastened to the shafts 15 at their one end, and to the lifting members 8 or fasteners 11 at their other end. The opening of the gripper is most preferably measured by an absolute sensor 21 connected to the power unit's 14 axis or the turnplate, or by another opening measuring device.

Figure 3:
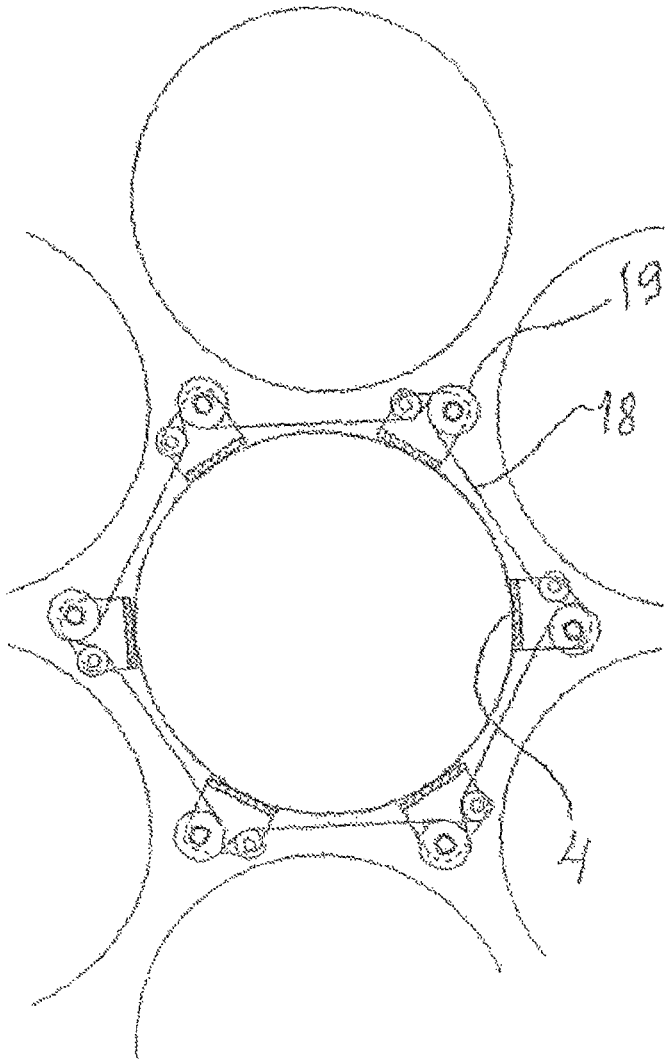
FIG. 3 shows a simplified top view of one embodiment of the invention located in a vertical roll warehouse.
Figure 4:
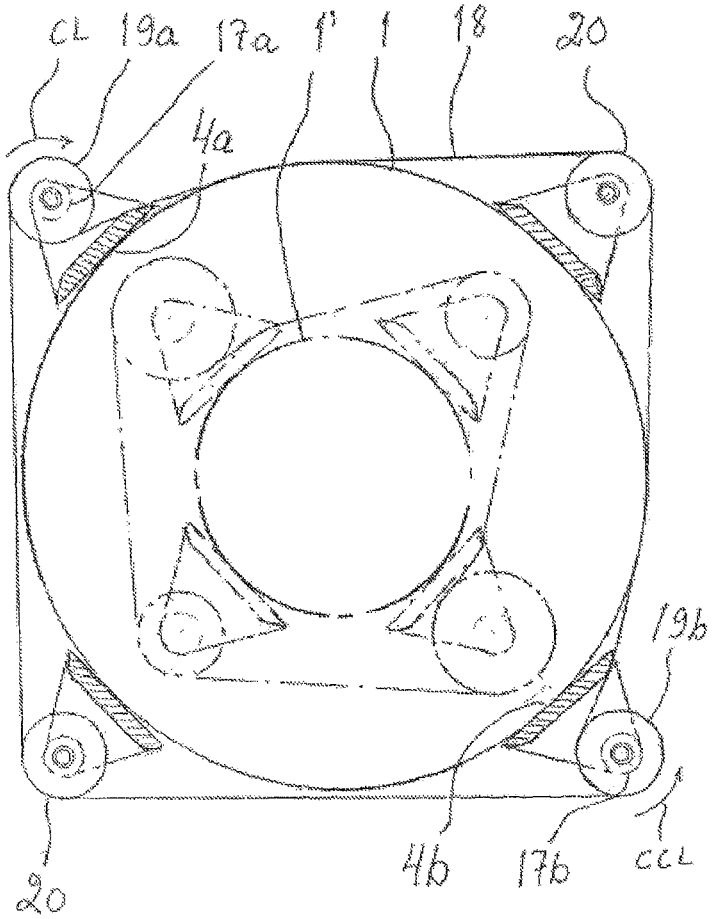
FIG. 4 shows the operating principle of one embodiment of the invention.

The operating principle of a gripping apparatus is apparent from FIG. 4. The griping apparatus, indicated with a solid line, is gripping a roll 1 of a larger diameter. The same gripping apparatus, indicated with a dot-dash line, is gripping a roll 1' of a smaller diameter. When the apparatus tightens its hold or when being moved to grip a roll of a smaller diameter, a winding member 17*a* rotates clockwise round its axis in the direction of arrow CL, and a winding member 17*b* rotates counter-clockwise round its axis in the direction of arrow CCL. In the embodiment depicted, both winding members 17*a* and 17*b* wind round them a tensioner or binder 18 from both directions on spools 19*a* and 19*b*. One or more idlers, such as idling drums 20, may be provided between the winding members. Both the winding members and the idlers are each connected to a separate contact member and lifting member. In the embodiment in FIG. 3, a gripper equipped with six lifting and contact members is located in a roll warehouse between roll piles.

Figure 2:
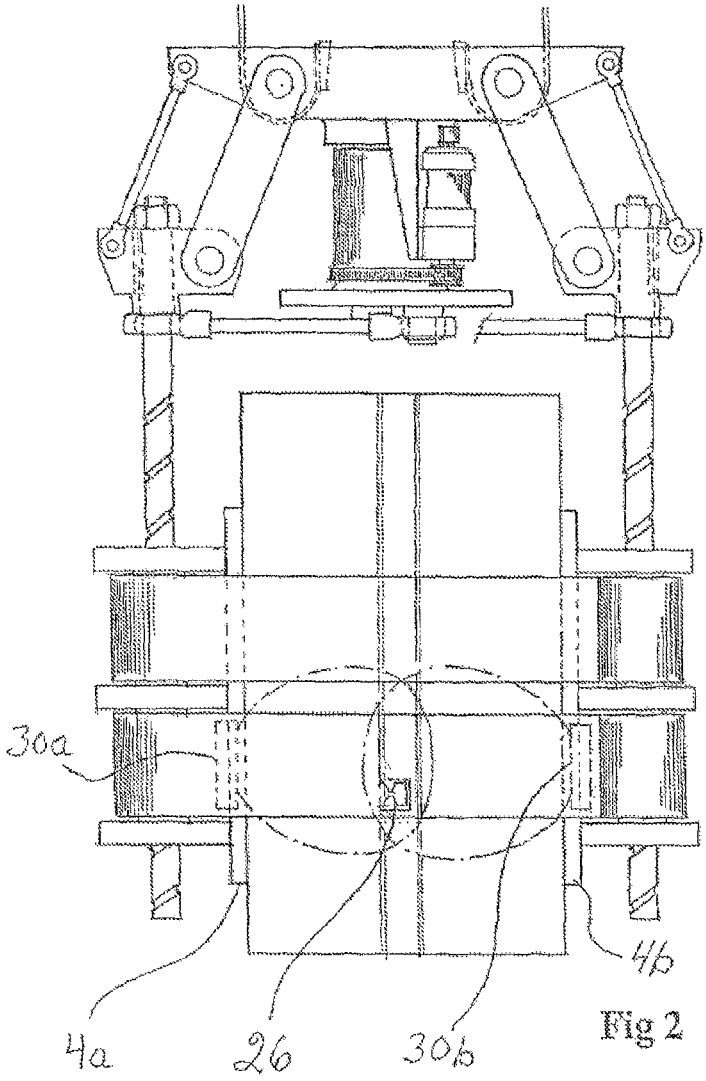
FIG. 2 shows a side view of another embodiment of the invention.

In the embodiment in FIG. 2, at least two contact members are most preferably provided with antennae 30*a* and 30*b* of RFID read/write devices. The antennae are most preferably located in lower parts of the contact members. Therein, when the gripper is lowered to embrace the roll/roll pile or vice versa, RFIDs 26 of all rolls to be transported can be read/written during the vertical movement. The antennae are most preferably located in the contact members so that their sectioning differs from 180 degrees.

In the embodiments depicted, the binder is wound on the same spool from two directions. One embodiment (not shown) enables achieving approximately double holding power with the same tightening torque of a winding member with regard to bidirectional winding. Therein a binder 18, preferably a belt, is fastened at one end integrally to a contact member or fastening structures of a winding member, and at the other end to a spool of the winding member for winding.

One or more winding mechanisms 17, 19 with their binders 18 may be provided in parallel in the vertical direction. A plurality of parallel mechanisms enables spreading the tensile force over a broader area and using more lightweight binders, thinner belts, for example. Parallel binders also enable achieving relatively even tensioning over the width of the roll, even with a roll of varying thickness. In one embodiment of the invention, parallel binders also enable tensioning around different rolls piled on top of each other, even when the diameters of the rolls slightly differ from each other.

The gripper may be appreciated to operate as follows:

A rotating movement is conveyed from the power unit 14 to the turnplate, resulting in the lifting members 8 being pushed outwards from the center. A counterforce is generated, keeping the binder tensioned when motors 22 rotating the lifting members round their axes of revolution provide a torque that tends to rotate the winding members 17 so that the binder 18 surrounding the roll 1 tends to tension. The movement of the lifting members is stopped when the radius of a circle passing through the inner surfaces of the contact members is approximately 100 mm longer than that of the roll to be gripped. The gripper 2 is lowered so that the lowest gripping mechanism 3 is at a height where the lower edges of the contact members 4 are close to the lower end of the roll 1 or the lowest roll in a pile 1*a*. RFIDs (26) of the rolls to be transported can be read during the vertical movement. Next, the motors 22 rotate the winding members 8 in the direction/directions causing the perimeter of the binder 18 to be reduced, wherein the contact members 4 are pressed against the roll 1. The movement is stopped when a torque sufficient to maintain adequate gripping force in the gripping apparatus is achieved. Most preferably, the hold of the grip between the contact member and the roll or a related quantity, such as compression force, is simultaneously measured by a hold sensor 32. The hold sensor may comprise any one of the following: a piezoelectric element and a strain gauge. A gear of the winding motor 22 is preferably self-retentive, and/or the winding motor and/or the winding mechanism is equipped with a brake. Therein, electric power need not be supplied to the motor during the moving of the roll, and thus a potential power failure cannot cause the risk of the roll being released from the grip. Straining of the binder 18, elastic compression of the roll and structural flexibility combine to cause a tension/holding power that is maintained during the moving of the roll.

When the roll/roll set has been lifted a few hundred mm, a safety mode is switched on by one or more actuators 24, wherein, during the critical phase of the moving of the roll/roll set, at least one retention member 25 of a safety device 23 is positioned below the lowest roll 1*a* in a safety position S.

The gripper holding the roll(s) is lifted against docking members known per se, pertaining to a lifting mechanism of a crane.

Upon being lifted to a docking position, the gripper may connect to a compressed-air connection of a lifting device, wherein a compressed-air tank provided in the gripper is filled while the gripper is connected in the docking position.

The crane moves the gripper holding the roll(s) to an unloading position.

The crane starts to lower the gripper holding the roll(s).

Before the roll reaches the level of the unloading location, the retention members are moved from the safety position S to an unengaged position S'.

When approaching a top-most roll in a pile potentially located in the unloading position, the rolls being gripped are preferably aligned with the top-most roll in the pile. Such aligning enables reducing staggering generated in the pile and enables taking rolls from the pile without the need to slide the rolls in the pile sideways.

The lowering is continued until the roll has reached the level of the unloading position.

The motors 22 wind the binders in the open direction and, at the same time, the power unit 14 pushes the lifting members/contact members outwards from the roll.

When the gap between the contact member and the roll is approximately 50 mm to 100 mm, the lifting mechanism lifts the gripper in an upper position, after which the gripper is moved to the next loading position.

The functions mentioned above are carried out automatically under the control of a programmable logic and/or computer.

In one preferred embodiment, the safety device 23 may be shifted from the unengaged position S' to the safety position S using a single linear actuator, such as an air cylinder. Therein a solution known from a rifle lock, for example, is applied. The safety device is connected to a conveyor that moves in the vertical direction in a corresponding guide slot. The safety device first moves rectilinearly in the vertical direction, and when it has progressed substantially to the level of the lower end of the roll, where the guide bends after its rectilinear portion, the retention member 25 is forced to turn below the lower end of the roll 1. The expression "critical phase of the moving" refers to that part of the transport where significant damage may be caused if the roll drops.

Figure 5:
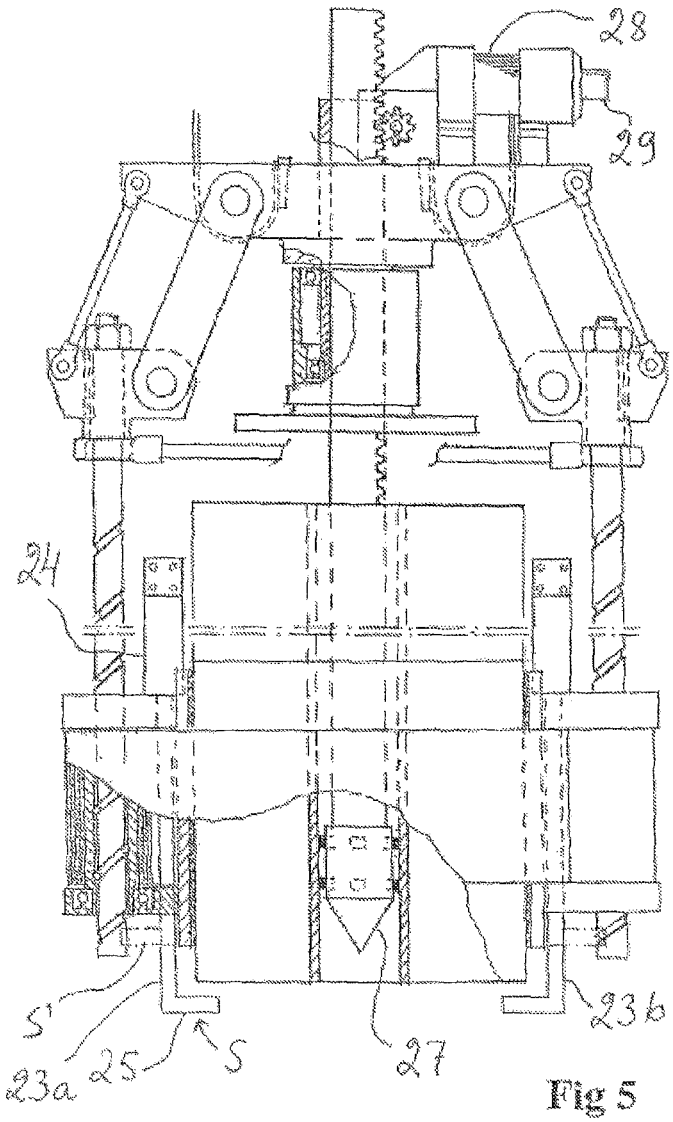
FIG. 5 shows a partially sectional and simplified side view of another embodiment of the invention.

The embodiment of the invention shown in FIGS. 2 and 5 is preferred in cases where roll diameter variation is minor. In said embodiment power units may be omitted from the winding mechanisms, or, alternatively, they may be assisted.

A gripping apparatus 3 moves in the vertical direction controlled by a lifting member 8. The lifting member 8 is preferably a ball screw with very large pitch (considerably larger than that shown in the figures). The movement of the gripping apparatus with regard to the lifting member in the axial=vertical direction forces a winding member 17 to turn round the axis of the lifting member 8. The winding member 17 is most preferably a ball nut or similar. The winding member is mounted on a bearing to be able to rotate in relation to the contact member 4. A binder 18, such as a belt, strip, folio, wire rope or similar, is spooled round the winding member. The binder is fastened at its ends to the winding members 17 of adjacent contact members, forming a spool 19 around them. Said embodiment operates as follows: First contact members of the gripper are caused by the power unit to make initial compression contact with a material web roll. Subsequently, when starting to lift the gripper, the initial compression causes a force counteracting the lifting due to friction, which force is forced by means of transmission to turn into a tractive force between the contact members. The actual gripping force is generated as a counterforce of the traction when the contact members are pressed more tightly against the material web roll. The transmission is designed so that the generated gripping force is able to prevent the hold of the contact members from slipping, thanks to friction.

The embodiment in FIG. 5 presents a solution to a "telescoping" problem. The embodiment in question may be applied to unpackaged rolls. A gripping mandrel 27 is provided at the center of the gripper, the mandrel being either integrally fastened to the body of the gripper or movable in the vertical direction by a lifting power unit 28. The gripping mandrel, whose structure is known per se, grips a roll/lowest roll 1*a* at the inner surface of its core and contributes to the carrying of the roll(s) during moving. The positioning of the gripping mandrel is most preferably based on measurement data from a sensor 29 provided on the axis of the lifting power unit. An embodiment is also possible wherein the RFID read antenna mentioned above is located in connection with the gripping mandrel. Therein the read distance is very short and the reliability of reading is good. Instead of the gear rack transmission depicted, the gripping mandrel 27 may be hung from a wire rope, chain, belt or similar. This enables reducing the need for space above the gripper.

Figure 6A:
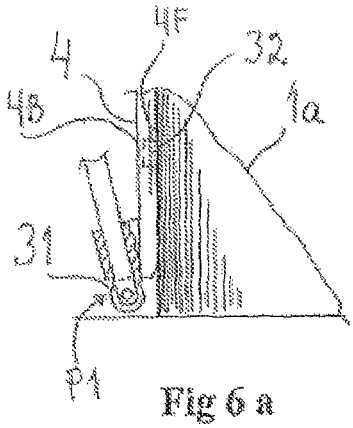
FIGS. 6*a*, 6*b* and 6*c* show a simplified side view of the aligning of a roll being moved with a pile at different phases of the moving.
Figure 6B:
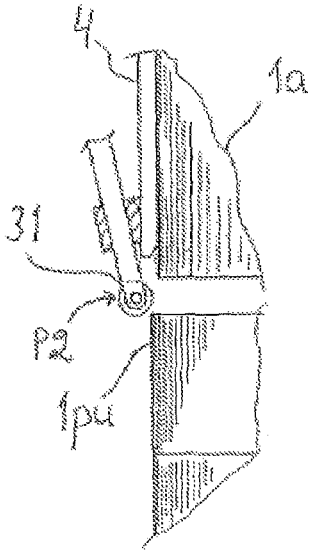
Figure 6C:
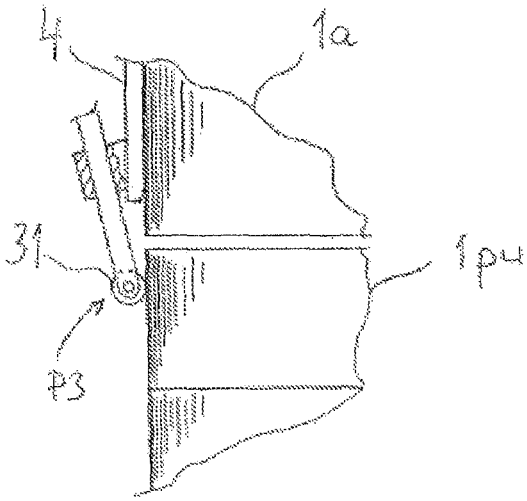

FIG. 6 depict different phases of the alignment of a roll/roll set being moved with a pile in a warehouse. In roll warehouses rolls are often placed in piles exceeding 10 meters in height. When a roll/roll set being moved is lowered on top of a pile in the warehouse, the roll/roll set is preferably aligned with a top-most roll 1*pu* in the pile. For the sake of clarity, the tensioning members of the gripper are not shown. In FIG. 6*a*, a roll/a lowest roll in a roll set 1*a* to be picked up is located in a loading position. Therein an alignment member 31 has been moved above the level of the lower end of the roll 1*a*, in position P1. Preferably at least three contact members are located with even spacing around the roll.

In FIG. 6*b*, the roll/roll set being moved is being lowered in the warehouse on top of the top-most roll 1*pu* in the pile. When approaching the pile, it is possible to move the contact member(s) 31 to a pre-alignment position P2, wherein the alignment member starts to guide the roll when it contacts the upper edge of the roll 1*pu* during the lowering movement. This saves time if the upper edge of the roll 1*pu* can be assumed to endure the stress caused by the contact.

Most preferably, the roll/roll set is lowered so close to the upper end of the roll 1*pu* that the contact members avoid the upper edge of the roll 1*pu*. Subsequently, the alignment members are moved to position P3, where mating surfaces of the alignment members facing the roll are tangential to an imaginary extension of the envelope of the roll 1*a* below the roll 1*a*. When moving to position P3, the contact members simultaneously align the roll 1*a* with the roll 1*pu*. Most preferably, the alignment takes place simultaneously when the roll/roll set is being slowly lowered on top of the roll 1*pu*.

The mating surface of the contact member 31 resting against/tangential with the roll 1*pu* may be formed from a roller, a ski or similar.

When a roll set is being gripped, it is necessary to ensure a safe hold of the lowest roll 1*a* before starting to lift, and most preferably a safe hold is continuously ensured during the moving as well. A safe hold may preferably be ensured by at least one pressure sensor 32 integrated into the structure of the contact member 4. The sensor known per se is outlined in FIG. 6*a*. The pressure sensor measures the compression of a sensing part 4*f* of the contact member, contacting the roll 1*a*, against a rear part 4*b* of the contact member. The pressure sensor 32 is located between the rear part 4*b* and the sensing part 4*f*. Alternatively, a roller resting against the roll and connected to a pulse encoder may be provided in the contact member. If a safe hold is not maintained during lifting, the roll will slip in relation to the contact member; therein the roller and the axis of the pulse encoder with it will revolve. This enables receiving information on a poor hold from the pulse encoder. For example, in the case that the diameter of the lowest roll 1*a* in the pile is smaller than that of the rolls above it, a sufficient compression force is not necessarily generated on the roll 1*a* during tensioning. In this case an alarm is given based on information from the sensor/encoder, and moving is not initiated.

In addition to the solution related to FIG. 5, a number of other embodiments contributing to the ensuring of a safe hold of the grip are possible. The contact members 4 may be covered with surfacing material 5 that has a large friction coefficient and is elastic as well. The contact members may also be shaped into suction plates to increase their gripping force by means of suction. Furthermore, other gripping solutions known per se may be combined with the gripper in accordance with the invention. For example, a suction plate may be provided to grip the upper end of a roll.

One embodiment combines the solutions shown in FIGS. 1, 2 and 5. First contact members are caused by a power unit/power units to apply initial compression against a roll. Subsequently, the power unit is locked in said position, and the weight of the roll is caused by wedging members or similar to make the contact members compress the roll and maintain a grip of it when the roll is being lifted, and the gripping force is substantially relative to the weight of the roll.

Electric, pneumatic or hydraulic power units may be used in the movement mechanisms of the gripper.

Figure 7:
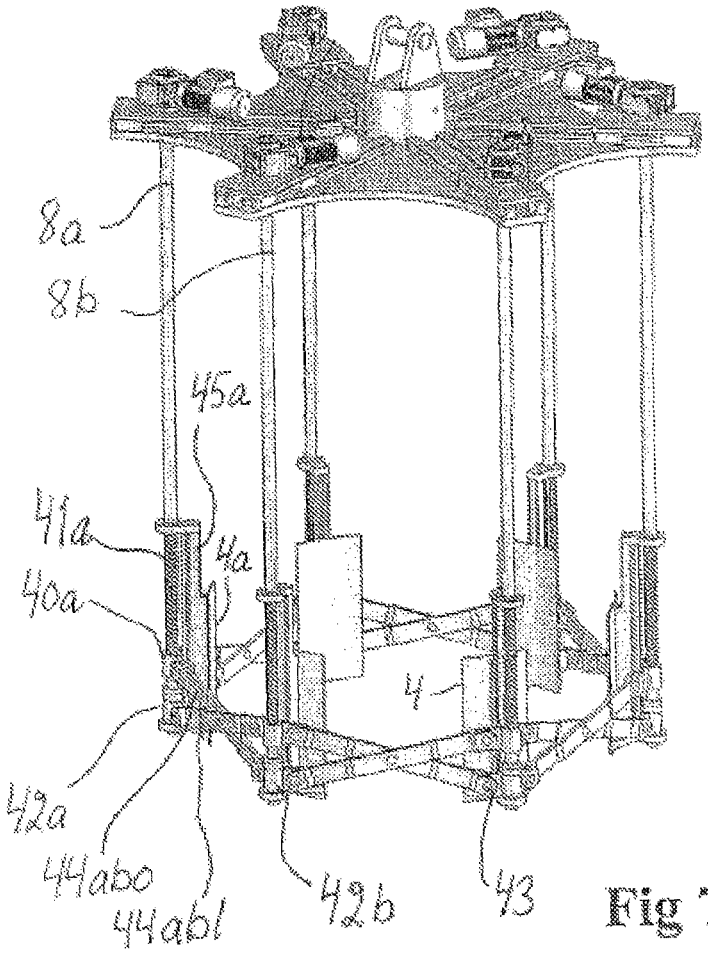
FIG. 7 shows a gripper in accordance with one embodiment of the invention in an open position.

FIG. 7 shows an embodiment wherein a binder consists of scissor levers 44 most preferably connected to lifting members 8 by means of joints 43. For example, a scissor lever 44*abo* connecting lifting members 8*a* and 8*b* is connected at one end to a nut 40*a* moving on a screw portion 41*a* of the lifting member 8*a* and at the other end to a lower fastener 42*b* fastened to the adjacent lifting member 8*b*. A scissor lever 44*abl* intersecting the scissor lever 44*abo* is connected at one end to the lower fastener 42*a* of the lifting member 8*a* and at its other end to a nut 40*b* moving in a screw portion 42*b* of the adjacent lifting member 8*b*. When the lifting member 8 is rotated by a power unit 11 fastened to the upper end of the lifting member, the nut 40 moving on the screw portion 41 at the lower end of the lifting member moves in the vertical direction. When the nut moves upwards, the scissor lever pairs are turned in the direction of a vertical plane so that the perimeter formed by the lifting members 8 is reduced and the hold tightens. The power unit is also fastened to a carriage 47 that moves, guided by guides 49 attached to a body 46, substantially in the radial direction of the roll. These form a moving apparatus 50. The screw 41 is most preferably a ball screw.

The angular displacement range of the scissor levers 44 is adapted so that the gripping force changes substantially in relation to the diameter and/or weight of the roll.

Figure 8:
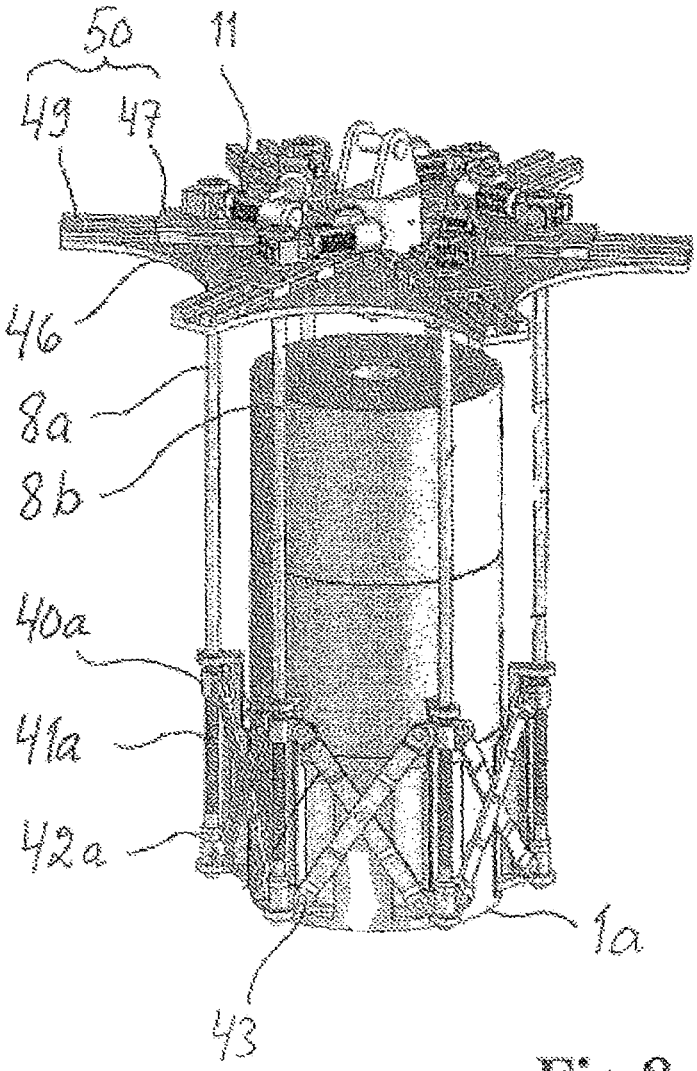
FIG. 8 shows the gripper in FIG. 7 gripping a roll pile.

FIG. 8 shows the gripper partially stripped, gripping a lowest roll in a roll set consisting of three rolls.

The horizontal profile of the binder 18 is of a substantially polygonal shape, most preferably a hexagon.

The moving apparatus 50 may naturally also be implemented with other kinds of members known per se.

Figure 9:
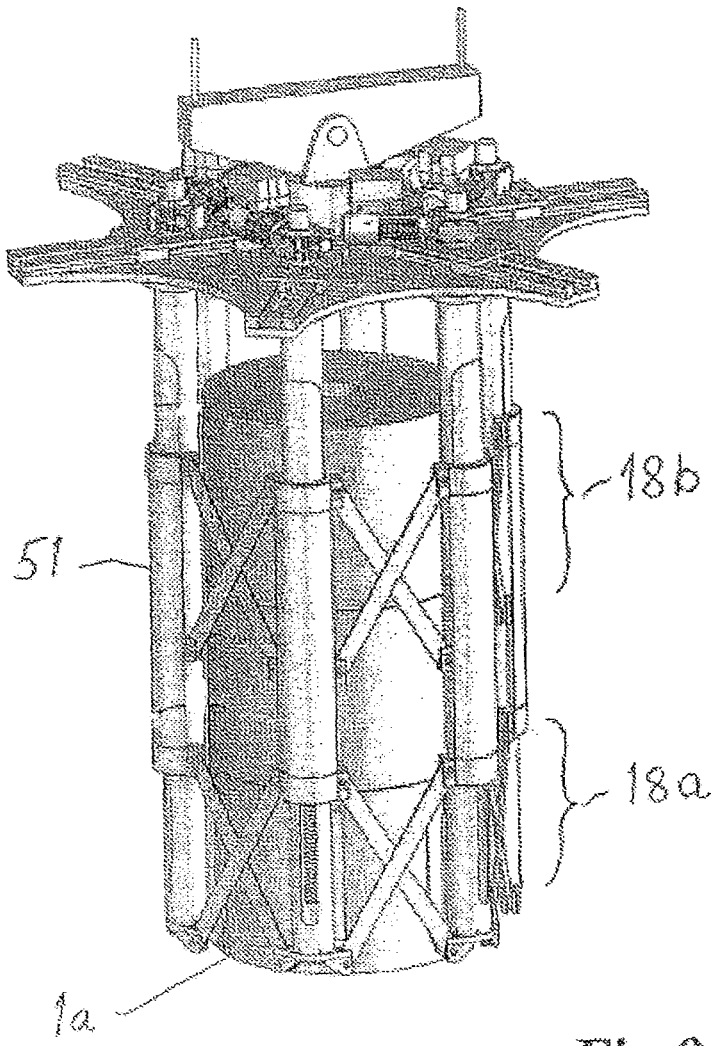
FIG. 9 shows a gripper in accordance with another embodiment of the invention gripping a roll pile.

FIG. 9 shows an embodiment wherein two binders 18*a*, 18*b* formed from scissor levers are provided on top of each other. Movement is preferably conveyed to one of the binders by means of a screw and a nut, and from there further to the other binder by means of a bridging member 51.

Figure 11:
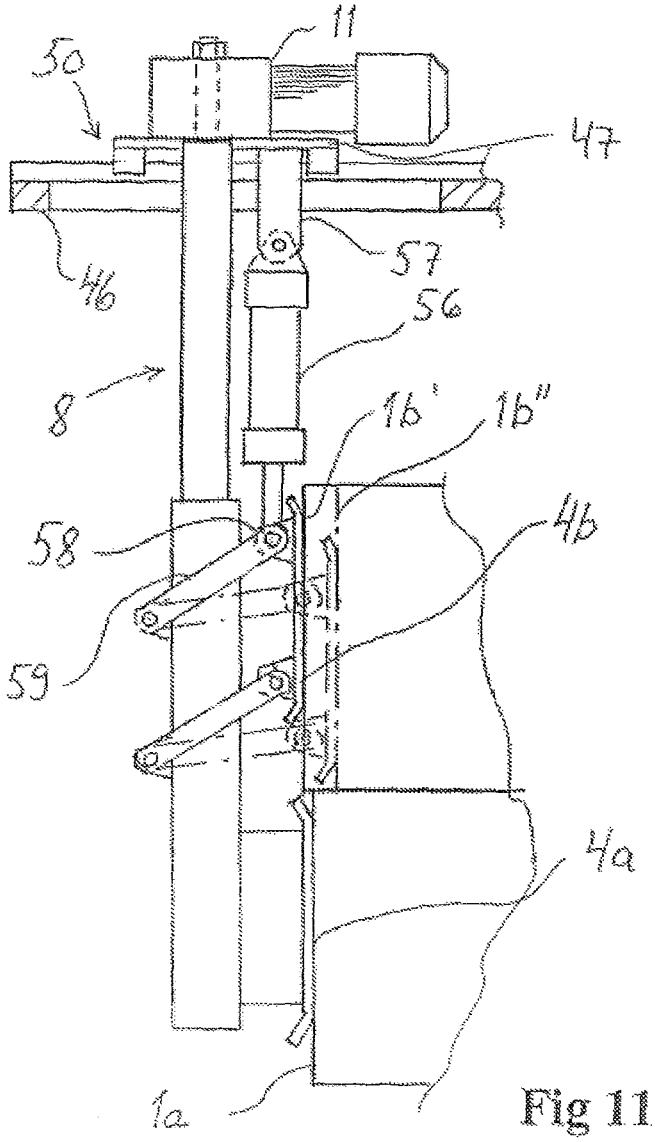
FIG. 11 shows a simplified view of the structure of the embodiment in FIG. 9, enabling centralizing individual rolls in a pile.

In one embodiment of the invention, upper contact members are provided in the area of effect of an upper binder 18*b*, and lower contact members are provided in the area of effect of a lower binder 18*a*. Said embodiment enables centralizing eccentric roll piles. Therein the binders may move/be tensioned independently with regard to each other in the radial direction of the roll. FIG. 11 shows one embodiment that enables moving an upper roll 1*b* in a pile in relation to a lower roll 1*a*. Lower contact members 4*a* are integrally connected to lifting members 8. Upper contact members 4*b* are connected to the lifting members 8 by means of a mechanism that enables substantially horizontal movement of the upper contact members 4*b* towards or away from the roll 1*b*. The moving mechanism may be implemented by means of a parallelogram 59, wedges or other members known per se. The movement in the mechanism is provided by a power unit 56, which may comprise a hydraulic cylinder, an electrical linear movement module or similar. Preferably all of the power units, or at least opposite power units moving the upper contact members, are adapted to provide movement synchronously to be able to centralize the upper roll 1*b*. Moving all of the upper contact members synchronously enables reducing any slipping of the contact member along the perimeter of the roll when loaded with considerable force, which would expose the surface of the roll to crushing. The power unit 56 is preferably fastened at its upper end to a carriage 47 by means of a fastener 57.

In the situation shown in FIG. 11, the roll 1*b* whose diameter is smaller than that of the lower roll 1*a* is located on top of the lower roll in an eccentric position 1*b*' in relation to the lower roll in the initial situation. The power unit 56 forces the contact member 4*b* by means of the scissor levers 59 to be pressed towards the roll until the roll is centralized in position 1*b*".

Figure 12:
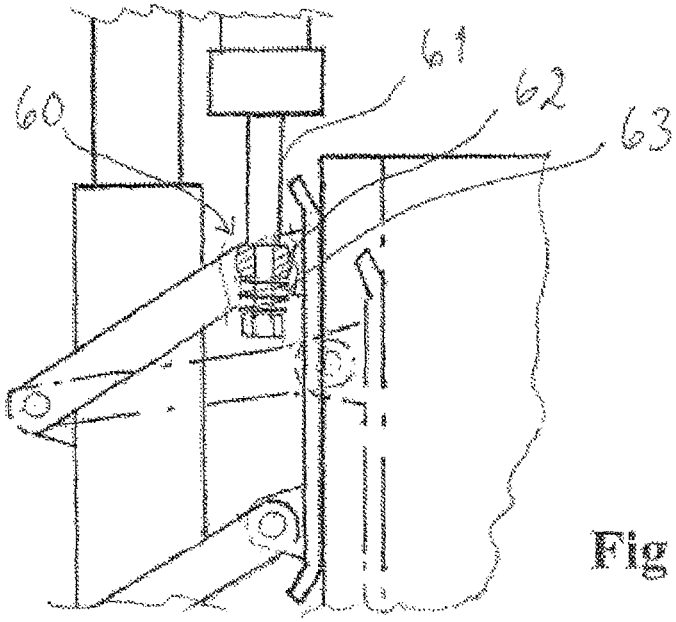
FIG. 12 shows a detail of the embodiment in FIG. 11.

FIG. 12 shows a mechanism 60 combined with the embodiment in FIG. 11, enabling applying to the upper roll a compression force that increases during lifting. A moving member 61 of the power unit 56 is floatingly connected to the contact member 4*b* or the mechanism 60 so that, when a centralizing movement ends, the contact member 4*b* may move downwards in relation to the moving member 60. A preferred solution comprises a hole in a shaft 62 between lugs 58, where a fastening part of the moving member may move, pressing a flexible member against the shaft. Frictional force between the contact member 4*b* and the roll 1*b* has a downward effect in a lifting situation and tends to turn the scissor levers 59 clockwise, wherein the scissor levers force the contact member more tightly against the roll.

Figure 10:
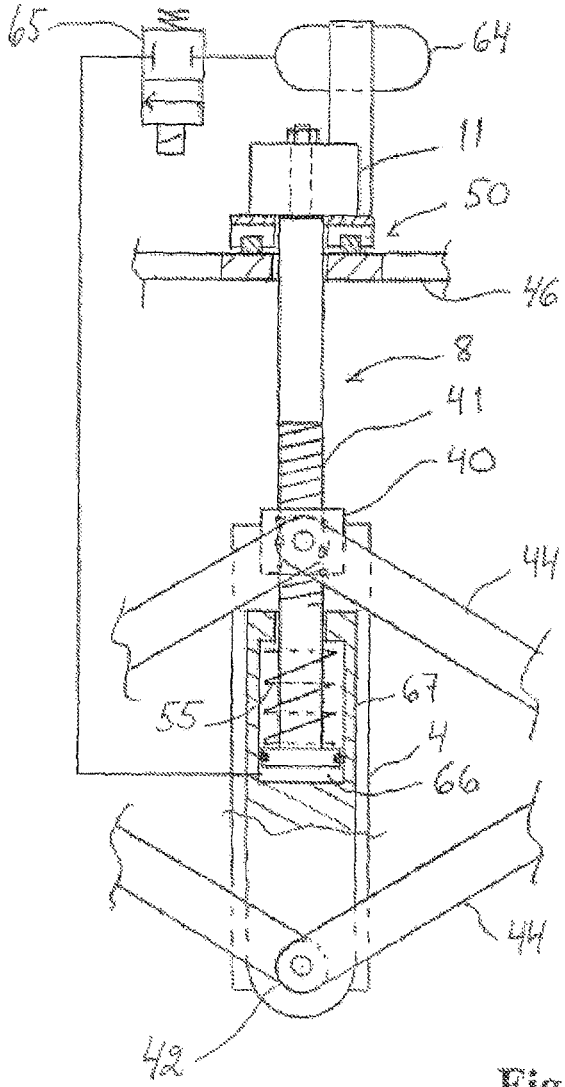
FIG. 10 shows one embodiment of the invention, presenting a simplified view of a mechanism for making the load cause an increase in the compression force.

A tensioning procedure shown in FIG. 10 may be arranged on the lower roll. This enables individually tightening the hold on specific rolls in a pile during lifting.

More than one binder with its contact members may be provided. The binders may also move/be tensioned even independently with regard to each other in the radial direction of the roll.

Contact members 4 resting against the roll 1 are connected to lifting members 8 by means of a support 45. A nut 40 preferably moves resting directly or indirectly against the support.

FIG. 10 shows one embodiment wherein the weight of the load causes the gripping force to increase, and the grip strengthens automatically during moving. Flexible members are arranged between a nut/upper joint 40 and a lower fastener/lower joint 42 in a common lifting member 8. The flexible members enable the lower fastener 42 to move in relation to the nut 40 when roll 1 is being gripped. Thus the roll 1 tends to press the contact member 4 downwards due to gravity and friction. The contact member, whose lower end is fastened to the lower fastener, conveys the movement to the lower fastener, which tends to move downwards. As the nut is locked in place, the downwards movement of the lower fastener generates a movement in the binder's scissor levers that tightens the hold. The flexible member 55 most is preferably formed from a rubber or plastic plate located between the parties to the movement.

FIG. 10 also shows a gripping force strengthening mechanism in accordance with a preferred embodiment of the invention. The strengthening mechanism comprises a pressure medium source 64, a medium valve 65 and a pressure space 66 in connection with a screw, which pressure space is defined by a cylinder 67 connected to the contact member 4 and the head of a screw part 8 fitted as a piston in the cylinder, and pipelines for conducting the pressure medium from the pressure medium source 64 via the medium valve 65 to the pressure space 66. The pressure medium source is preferably a pressure tank containing high-pressure gas, such as nitrogen or carbon dioxide under a pressure of 100 bar (10 MPa), for example. The pressure medium source may comprise a compressor. In one preferred embodiment of the invention, the strengthening mechanism is adapted to provide an emergency stop mechanism, which enables causing a sudden increase in the gripping force. Should a roll hanging from the grip start to slip despite the self-adjusting operation provided by the flexible member 55, the grip can be rapidly improved to stop the slipping that has already started. The strengthening mechanism may be implemented to strengthen the grip gradually or, as necessary, apply a relatively large gripping force in a single step in order to be able to stop the slipping as securely as possible.

The medium valve may be controlled electrically, pneumatically, hydraulically or mechanically. For example, a sensory member (not shown in the figure) may rest against the upper surface of a roll or roll pile being lifted so that, if the roll unintentionally slips from the grip, the sensory member controls the medium valve 65 to conduct pressure in the space 66 so that, by compressing the flexible member, the perimeter of the binder is reduced and the gripping force increases. The flexible member may be implemented so that, when exposed to a force exceeding a certain limit, the flexible member yields either reversibly or irreversibly so that the lifting member is able to move the lower fastener 42 further away from the nut 40. The limit is preferably set so that the limit is only reached due to pressure conducted through the medium valve.

Electric, pneumatic or hydraulic power units may be used in the movement mechanisms of the gripper. The nut 40 may also be located below the fastener 42.

Various embodiments of the invention have been presented above. It is apparent to those skilled in the art that the invention may be practiced by combining any of the features presented above. Thus the present invention is only limited by the appended claims.

The invention claimed is:

1. A gripper for gripping and for lifting vertical material web rolls, the gripper comprising:

a body having a central axis;

a plurality of guides attached to the body;

a power unit slidably attached to each of the guides;

a screw rotatably attached to each of the power units;

a nut attached to each of the screws;

a plurality of scissor levers attached to each of the nuts; and a plurality of contact members attached to the scissor levers, wherein the power units are configured to rotate the screws to move the nuts up or down such that when the nuts move up then the scissors are configured to open up which in turn forces the power units to slide along the guides inwardly towards the central axis and in turn forces the screws and the contact members to move inwardly towards the central axis, and wherein when the nuts move down then the scissors are configured to close which in turn forces the power units along the guides outwardly away from the central axis and in turn forces the screws and the contact members to move outwardly away from the central axis.

* * * * *